United States Patent [19]

Sendzimir

[11] Patent Number: 4,552,299

[45] Date of Patent: Nov. 12, 1985

[54] INTERMEDIATE ACCUMULATING SYSTEM IN PROCESSING STRIP MATERIAL

[76] Inventor: Tadeusz Sendzimir, P.O. Box 1350, Waterbury, Conn. 06720

[21] Appl. No.: 616,665

[22] Filed: Jun. 4, 1984

Related U.S. Application Data

[63] Continuation of Ser. No. 421,067, Sep. 22, 1982, , which is a continuation of Ser. No. 162,681, Jun. 25, 1980, abandoned.

[51] Int. Cl.[4] ..... B23K 31/02; B21C 49/00; B21C 47/26

[52] U.S. Cl. ..... 228/5.7; 29/33 S; 29/33 B; 29/33 Q; 228/47; 226/118; 226/189; 242/78.1

[58] Field of Search ..... 228/5.7, 5.1, 18, 47; 29/33 S, 33 Q, 33 B, 33 P; 72/227, 228, 230; 226/118, 189; 242/55, 55.18, 55.19 R, 76, 78.1, 80

[56] References Cited

U.S. PATENT DOCUMENTS

| | | | |
|---|---|---|---|
| 1,844,118 | 2/1932 | George | 72/228 X |
| 2,196,600 | 4/1940 | Wean et al. | 29/33 B |
| 3,281,917 | 11/1966 | Teplitz | 29/33 S |
| 3,310,255 | 3/1967 | Sendzimir | 228/47 X |
| 3,583,621 | 6/1971 | Bryant | 226/189 |
| 3,587,276 | 6/1971 | Randich | 72/250 X |
| 3,700,157 | 10/1972 | Shumaker | 228/5.7 |
| 3,721,114 | 3/1973 | Yazawa et al. | 72/250 X |
| 3,885,748 | 5/1975 | Costello et al. | 242/78.1 X |
| 3,999,718 | 12/1976 | Ziemba | 242/55.19 R |

FOREIGN PATENT DOCUMENTS

| | | | |
|---|---|---|---|
| 406286 | 11/1943 | Italy | 29/33 Q |

*Primary Examiner*—Kenneth J. Ramsey
*Attorney, Agent, or Firm*—Samuel Lebowitz

[57] ABSTRACT

In the production of metal- and other strip materials in continuous lengths and in several operations or processing facilities, such strip is wound into coils of finite length after each operation, then transported to the next operation and again welded into one continuous web, coil after coil.

In order to avoid this wasteful practice a method and apparatus is disclosed which consists in feeding said strip emerging from one operation, without cutting it, directly into a variable capacity accumulator and feeding it out again from said accumulator into the apparatus of the following operation at the speed that such operation requires.

16 Claims, 7 Drawing Figures

INTERMEDIATE ACCUMULATING SYSTEM IN PROCESSING STRIP MATERIAL

This application is a continuation of application Ser. No. 421,067, filed Sept. 22, 1982, which in turn, is a continuation of application Ser. No. 162,681, filed June 25, 1980, now abandoned.

BACKGROUND OF THE INVENTION

An accumulator for strip material built according to U.S. Pat. No. 3,310,255 has solved the problem of continuously feeding modern fast steel strip processing lines where previously multiple-pulley looping towers did not give enough time for joining the next strip being, as it were, only a small fraction of said accumulator. The high storage capacity in that relatively compact accumulator is explained by its geometry: the strip is stored in form of two superposed, individually supported spiral coils, one right- and the other left-hand wound, the two joined together into one continuous length at their inner wraps, so that the strip enters the first coil tangentially, through a pair of pinch rolls, from outside and it leaves from the second coil in a similar way.

This accumulator has applications also in other branches of strip forming of which said patent shows two: such accumulator employed for feeding a continuous length of hot-rolled strip into a multi-stand tandem cold rolling mill without slowing down for butt-welding each new coil (FIG. 6) and its use in connection with a single-stand cold rolling mill arranged for a multipass one-way operation, the strip having been welded into a closed loop (FIG. 7 of that patent).

All of the above-listed and all known applications of accumulators, whether the herein referred to accumulator disclosed in U.S. Pat. No. 3,310,255, or the multiple traveling pulley accumulators, attack the problem of continuously feeding processing lines whose operation either must not be interrupted, such as galvanizing or annealing lines, or where equipment could be more fully utilized if operated without interruptions at the end of each coil, to butt-weld the following coil, e.g. rolling mill. Applicant has discovered, and is disclosing hereinafter, an entirely different application of variable capacity accumulators that offers substantial economic advantages in producing and processing metallic and nonmetallic strip material that can be treated in continuous lengths. This application is, however, limited to the use of large capacity strip accumulators, either of the above described or another type.

The application consists in using such variable capacity accumulator as recipient of the whole strip output of one production or processing line, followed by storing such strip material if necessary, and finally feeding it into the following processing line at such time and at such velocity as that line requires, or for final winding into coils or cutting up into sheets and packing, after the last processing operation.

The consequences of the present discovery can only be appreciated when compared with the one and only method now universally used in the strip and sheet producing industry where, e.g. in the steel industry, hot-rolled (pre-rolled strip is delivered in coils to the processing works and the operations such as: (1) pickling, (2) cold rolling, (3) annealing and temper rolling (4) galvanizing or aluminum coating, plastic coating etc are each followed by winding such strip into coils, including of course cutting it at the end of the coil, then tying the coil with steel straps securely to prevent unwinding in transport, followed by loading the coils on cars or conveyors to transport them to intermediate storage. Then lifting the coils again by crane or lift truck and depositing in cars or using conveyors to deliver them to the entry end of the following processing line where they are placed one by one on a pay-off reel and joined by welding to the following coil end the moment the preceding coil is unwound to the end.

Steady progress in the last three decades has led to providing equipment that can produce and handle heavier and heavier coils in order to reduce the number of times the coils must be welded to obtain a continuous length. At the present moment coils weighing 40 to 50 tons each seem to be the limit and one can image how securely such coil must be strapped for handling and transporation. Loosening of the straps could lead to serious accidents.

U.S. Pat. No. 4,152,919 illustrates the point. The patent discloses strip handling equipment to and from a multistand cold-rolling mill for aluminum strips. The equipment consists of heavy conveyors, lifting equipment to transfer the coils from the conveyors and placing them on multifloor shelves with similar equipment to take them off the shelves on the other side and huge five-coil cars delivering the coils from the hot-rolling mill. The abovedescribed system is represented as substantial improvement over prior art which is said to consist of cranes and lift trucks only. This patent further emphasizes the large storage areas needed to store the coils in production and the complications of coil handing.

By comparison, solving the same material handling problem according to the present invention by leading endless lengths of strip from one operation to the next one without the steps of winding them into coils, requires no handling equipment and no labor. It also requires a small fraction of the storage space because such accumulators can be built for huge capacities concentrated in small areas.

SUMMARY OF THE INVENTION

The present invention avoids the difficulties of the prior art by providing a method and apparatus for the production of strips or products made of strips of metals or other materials, involving a plurality of processing operations or facilities that are performed on continuous lengths of said materials. The strip is caused to continue to move from the end of one processing operation to a variable capacity strip accumulator, letting it remain there until apparatus of the next processing operation is ready to receive it, and then causing it to move, always in a continuous length, into and through said apparatus.

DESCRIPTION OF THE SEVERAL EMBODIMENTS

The embodiments are described in the sequence which has led to the gradual development of the present invention.

Figures 1, 2, 3, 4, 5:
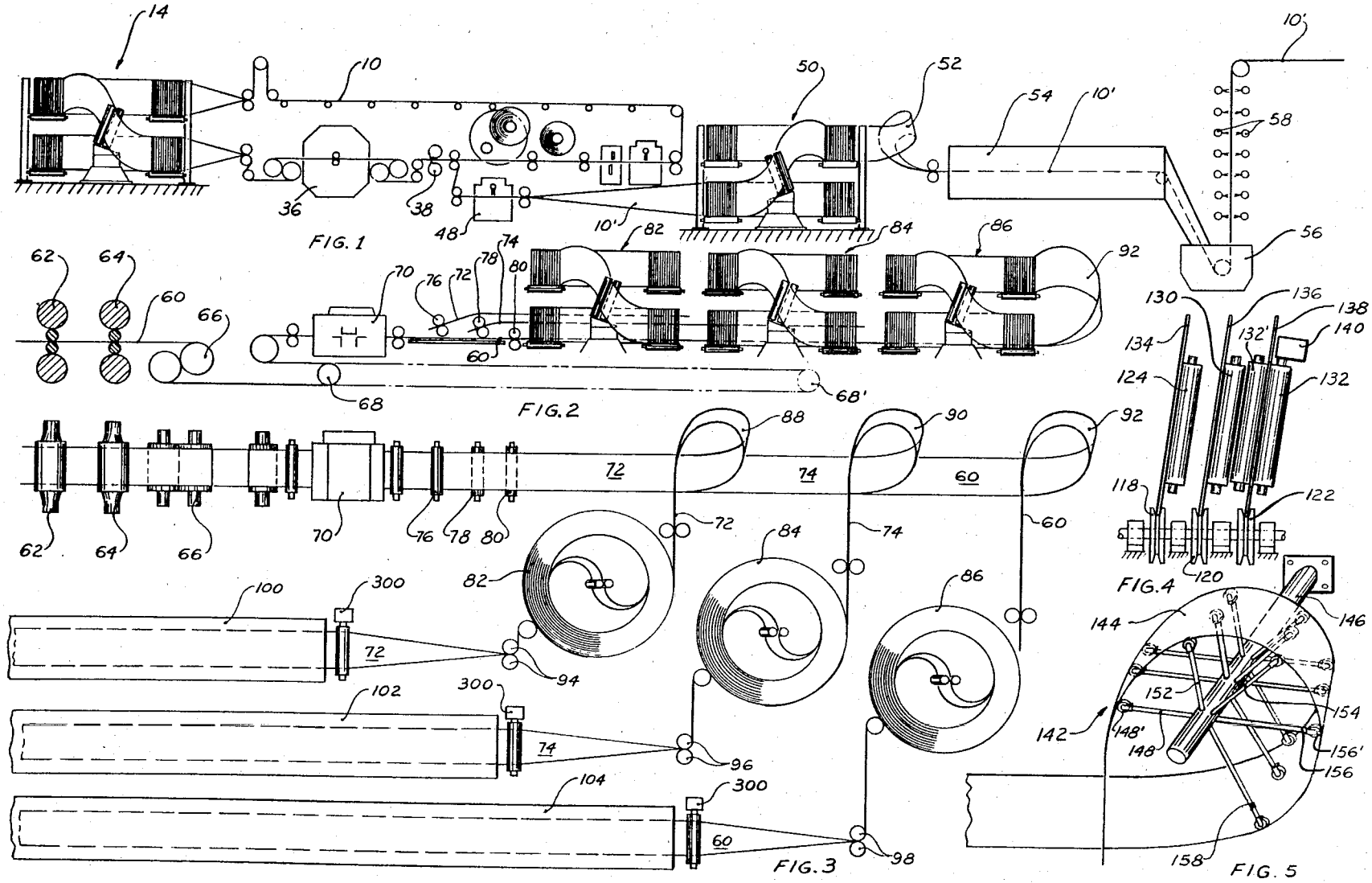
FIG. 1 comprizes a side elevation partially in section illustrating apparatus for cold rolling a continuous length of strip steel welded into a closed loop after which it is fed into a variable capacity strip accumulator and from the latter into a continuous heat-treating and metal coating line.
FIG. 2 comprises a side elevation in section.
FIG. 3 a plan view showing two finishing stands of a cold-rolling mill line for metal strip material after which said strip is fed into one of three variable capacity strip accumulators and from these into one of three processing lines.
FIG. 4 shows in cross section, a track for three strips comprising supporting and guiding rollers.
FIG. 5 is a three-dimensional view of a guide for leading a strip from the horizontal into vertical position or vice versa.

FIG. 1 shows apparatus for cold rolling a strip of metal, in this case steel, by several passes through one mill stand 36, the strip 10 always moving in one direction, in a closed loop. The strip is passed into and through the variable capacity strip accumulator 14 through mill 36 then over several supporting rollers over and back into the same accumulator 14, in a closed loop. The process thus far is disclosed in the cited U.S. Pat. No. 3,310,255 and the accumulator 14 is the same as disclosed in the patent, the disclosure and drawings of such patent being incorporated herein by reference. The novel feature of the present invention begins with the last rolling pass.

The strip is cut by flying shear 38 and guided by rollers into welder 48 and in it attached to the trailing end of a strip 10' stored in another accumulator 50. Mill 36 does not stop during said welding and the emerging strip is kept taut by one of the guiding pulleys which is arranged for horizontal displacement the details of which are not shown here.

During said last rolling pass the finish-rolled strip is taken up and guided into said accumulator 50. At the same time accumulator 14 which continues feeding mill 36 is being filled with fresh hot-rolled strip which is attached to the trailing end of strip 10 that has just been cut by shear 38.

Accumulator 50 is continuously feeding strip 10' to the processing line 54 through the twist-loop 52 which changes its position from vertical on edge to horizontal. Line 54 is the cleaning, annealing and precooling portion of the process which leads the strip downwards into the molten zinc pot 56 out of which the strip 10' emerges vertically upwards when it is intensively cooled by air blasts 58 to crystallize the coating, and then over a pulley toward further cooling. A metal with a melting point lower than steel may be used in lieu of zinc e.g., a metal selected from the group consisting of aluminum, tin and zinc. In this case, the hourly output of the mill 36 and the processing line 54 can be made equal, except that the mill produces strip in batches, i.e. it discharges it into the accumulator 50 during the rolling of the last pass only, while the processing line must operate at uniform speed all the time. The accumulator has enough capacity to permit such operation, the result is the elimination of labor that was needed to wind into coils the finish-rolled strip, elimination of the cost of transportation of the coils to the galvanizing line and also elimination of the crew that was needed to feed said coils into the galvanizing line 9 which means, typically, waiting 30 minutes for a coil to be processed by the unit and then, when near the end of the coil, hurrying to prepare the trailing end of it for welding to the leading end of the following coil, a 2 to 3-minute job.

The apparatus in FIGS. 2 and 3 show how the foregoing principle can be used in connection with a more complex process such as rolling the strip on a multistand tandem cold rolling mill 62 and 64 which has capacity to produce enough strip to feed three or four processing lines. Several accumulators 82, 84 and 86 are fed by the tandem cold rolling mill 62 and 64, one after another which requires that the strip has to be cut and rewelded to the strip in another accumulator.

Millstands 62 and 64 are the last stands of the tandem cold strip rolling mill for which tension bridles 66 are provided which apply tension in the strip 60 downstream of mill stand 64. The strip 60 passes through tension bridles 66 and the roll 68 into combination cutter and butt-welder 70 which is adapted to selectively cut and weld strip 60 to any of the webs 72 and 74 stored in auxiliary accumulators 82 and 84 respectively. Strip 60 is stored in accumulator 86. Accumulators 82, 84 and 86, like accumulator 50 is identical to and functions in the same manner as accumulator 14 described herein.

The attachment of strip 60 to the strips in one of the accumulators 82, 84 and 86 is required only once every few hours in view of the enormous capacity of the accumulators. Yet, in order to reduce or eliminate the down time of the mill 62 and 64, a loop pulley 68 is providd with means to gradually shift it from position 68 to position 68' so the mill 62 and 64 can continue to revolve. If desired, an accumulator such as accumulator 14 can be used in lieu of loop pulley 68.

Pinch rolls 76, 78 and 80 are provided so that the end of the selected strip 72, 74 or 60 can be pulled back from its accumulator far enough to be butt-welded in apparatus 70. Such strip is then guided into its respective accumulator via its twist loop 88 etc. so as to turn it into an upright (on edge) position.

At the entry end of accumulators 82, 84 and 86, each strip 72, 74 and 60 respectively is twisted into an on edge vertical position by twist loops 88, 90 and 92 respectively, the twist loops and the apparatus for producing this configuration being more fully described hereinafter with respect to FIG. 5. Strips 72, 74 and 60 then pass out of accumulators 82, 84 and 86 through pinch rolls 94, 96 and 98 respectively. Strip 72 then passes into processing line 100, strip 74 passes into processing line 102 and strip 60 passes into processing line 104 for further treatment whether it be degreasing, annealing, electrolytic coating, galvanizing or coating with a plastic material or winding into coils and packing for shipment. The strips 72, 74 and 60 usually are run at a steady velocity day and night without interruption, otherwise the whole length of strip in such line would have to be discarded as scrap material, especially in heat-treating lines. Each of the accumulators 82, 84 and 86 can hold enough strip for as much as eight hours of operation of a line but the tandem mill 62 and 64 can fill each accumultor in two hours and thereby keep all lines going 24 hours around the clock.

The layout and programs of certain works may make it necessary to be able to also switch the strips between the accumulators 82, 84, 86 and the processing lines 100, 102, 104 in FIG. 2 and 3. The number of accumulators may also not be the same as the number of processing lines. In order to cover all the combinations required there would be several welder instrumentalities 70 provided on several levels so as to permit strips to pass or cross each other. Besides this, all strip paths involving turns must be arranged for strip in an "on edge" position.

Combination cutter and butt-welded devices of the type indicated schematically by element 70 in FIG. 3 are well known in the metal working arts which require continuous strip feeding lines. Exemplary of such are Model DMI Automatic Shear-Welder, and Model ME Series Zipwelder, distributed by Guild International, Inc., 7273 Division Street, Bedford, Ohio, 44146.

A single operator would be required at the cutter-welder 70, the operator receiving instructions from a computer which controls the sequences of various orders, from the mill to the accumulator and the processing lines. A crew is only needed at the exit end of the last of the processing lines to coil and pack the finished strips.

Depending upon the lay-out of the works and the situation of the various divisions and production units, the paths and the distances, e.g. from the cold rolling mill to the several processing lines that depend on it for supply of strips may vary greatly. A processing line may also have one or more alternate sources of supply of strips. Yet these routes over which the strip must travel from one operation to the next one will remain the same for years, until some units are relocated or programs changed.

That means that the tracks with guides over which the strips move from one operation to the next one, once built, are permanent and the cost of transportation of the strip, i.e. its flow from one operation to the next one is negligible, even for relatively long distances. The design of such lines is simple and I prefer to have the strip travel while in a vertical, i.e. "on edge" position, its weight resting upon spaced v-groove rollers 118, 120, 122 and the body slightly inclined to the right or left from vertical so that the nearly vertical attitude makes roller support of strip face necessary from one side only. In this way it is easy to guide the strip around corners and also, it occupies only a little space laterally. Several strip tracks may run parallel to each other and occupy jointly very little space.

FIG. 4 shows such multi-strip track in cross section. Horizontal axis V-groove rollers 118, 120, 122 installed every few feet lengthwise of the strips provide lateral guiding and vertical support for strips 134, 136 and 138 which also lean laterally against rollers 124, 130 and 132 which are preferably plastic-coated to avoid danger of scratching the strips. Pinch roller 132' and prime mover 140 are used to propel strip 138 and overcome any frictional resistance in the track. On the other hand, forming and processing equipment accepts the strip in a horizontal position. Even when the strip is caused to move vertically up or down, it passes over pulleys whose axes are horizontal. Hence the transition sections from horizontal to vertical and vice versa are an essential instrumentality in employing the subject process. I prefer to use one of two types of such "twist sections": a straight one, involving a simple twist, when space lengthwise of the strip is not restricted and no change in direction is involved. Such twist sections are shown upstream of the three processing lines 100, 102 and 104 in FIG. 3. Whenever, on the contrary, a change in direction is needed a compact and easy to support "loop twist" has been developed. They are marked 88, 90, 92, shown in the same figure on the stretch between the welder 70 and the accumulators 82, 84, 86. FIG. 5 shows such "loop-twist" instrumentality in plan view, as enlarged detail in FIG. 3. Strip 144 which is at first in a horizontal position, is inclined upwards and simultaneously twisted to emerge in vertical position and at right angle to the original direction. An inclined mast 146 which is solidly anchored to the floor through its base plate serves as support for a plurality of branches 148, 152, 154, 156, 158 affixed onto it radially in several directions around the circle and terminating each with a guide roller, 148' etc. All of the latter serve together to guide the strip accurately, regardless of width, to follow the twist-loop curve. Such instrumentality may of course guide the strip either from horizontal into vertical but also vice-versa, from vertical into horizontal.

Combining the above elements into tracks for guiding the strips on their way between forming and processing lines and accumulators will permit them to adapt to most plant or works' layouts. To overcome frictional resistance in the guides in long distance tracks or in ones where there are many turns, pinch rolls 132' driven by booster motors 140 or other propulsion means may be provided. There may also be a need for means to transfer all or part of the strip stored in one accumulator into another one or of combining two or more accumulators in tandem to act as a single multiple-capacity auxiliary accumulator. Certain strips may have to be left in storage in a semi-finished or finished condition, some others may have to be held at customers' request, for later shipment. These and many other situations lead to a conception of a central accumulator storehouse where large and small quantities of a variety of strip materials could be stored safely and economically and be instantly available for further processing or slitting or cutting into sheets or only packing. Such storehouse could comprise, say, two rows of closely spaced accumulator positions, 10 in each row, with two accumulators, one on top of another, at each position. Since there would be no personnel and no elevators, there would be no point in trying to avoid a multi-story layout. The investment cost would be substantially less than conventional storehouses for coils and sheets, since the 40 accumulators could be laid out as a joint structure that would also support the roof and light walls. There would be no need for cranes or alleys for lift trucks. There would be no windows to waste heat and in the winter heat be needed only to prevent rusting from condensation. Keeping the dew point low would suffice.

Figure 7:
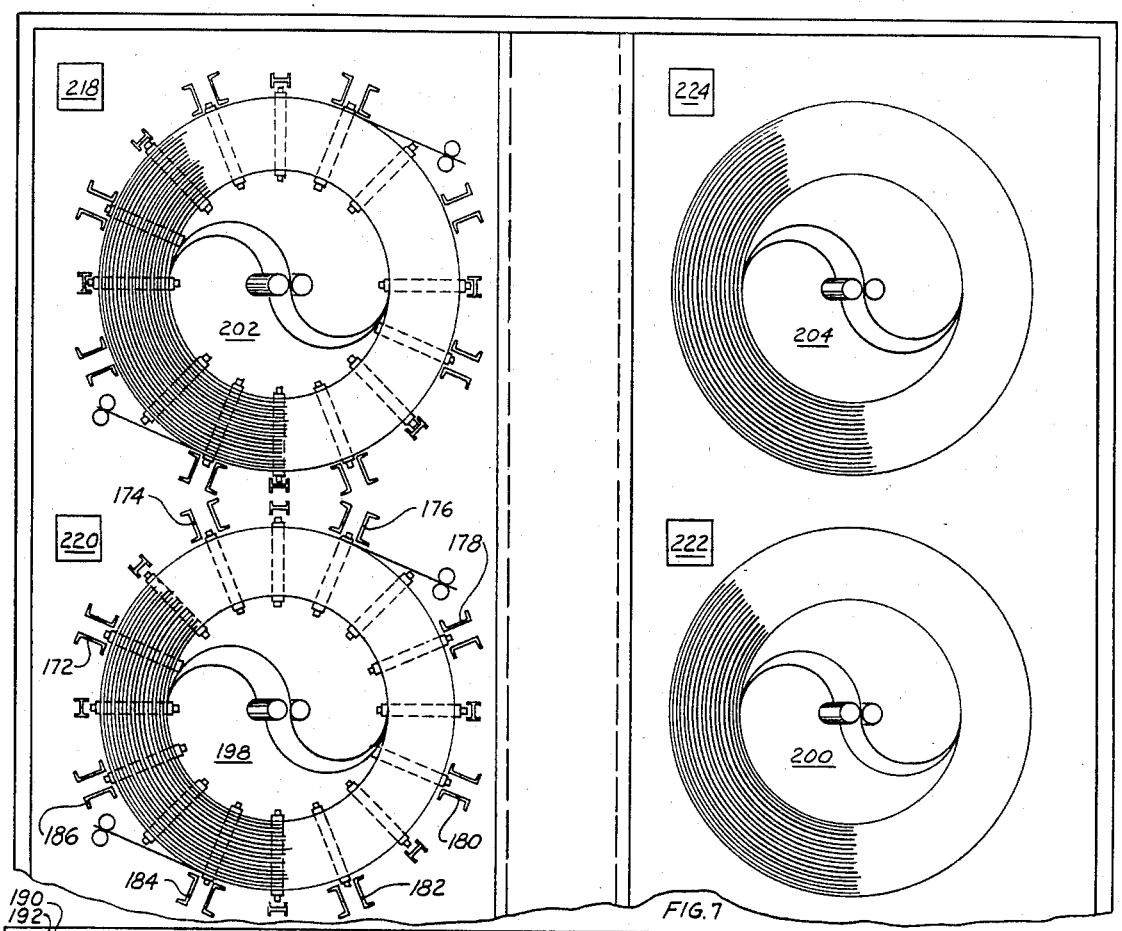
Figure 6:
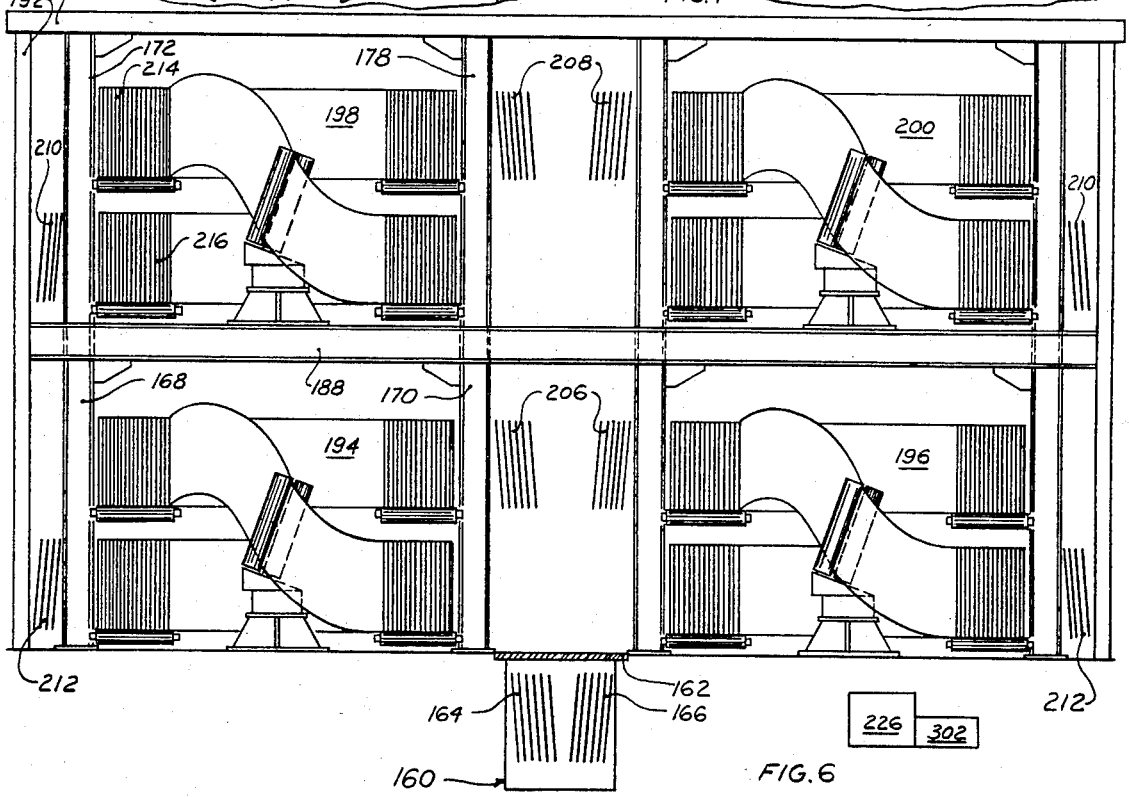
FIG. 6 is a cross section of a storehouse structure with a plurality of operatively connectable auxiliary variable capacity strip accumulators installed therein, and FIG. 7 comprises a partial plan view, partially in horizontal section, of FIG. 6.

FIGS. 6 and 7 show such warehouse in schematic vertical section and plan view, respectively. The accumulators are arranged in two rows: 194, etc. in one row on the ground floor and 198, 202 etc. on the second floor; in the other row are accumulators 196 etc. on the ground floor and 200, 204 etc., on the second floor. Each accumulator is shown as having sixteen structural posts each supporting driven rollers jointly supporting and causing rotation of the stored coils 214, 216 disposed around the outer periphery of the coils 214, 216, some of which such as 172, 174, 176, 178 etc. extending from the foundation of the building through the second floor 188 and up to the roof 190 so that those posts form jointly the structure of the warehouse building including the support of the floor and the roof 190. In turn, the roof and the floor may support light curtain walls 192 that may even be windowless, since the operation is essentially automatic or at least remotecontrolled. A canal or passage 160 covered by a removable roof 162 and disposed centrally, lengthwise the building is an extension of tracks for strips which are coming underground from several manufacturing divisions of the works to the accumulator warehouse and are at appropriate times guided from said warehouse to other divisions to be subjected to other manufacturing processes.

Multiple tracks 206, 208, 210 and 212 etc. are provided to guide strips arriving through said canal 160 to corresponding accumulators and to guide said strips back from their accumulators into said canal 160 for distribution to corresponding works divisions as mentioned above.

In order to guide any strip from tracks 164 in canal 160 which lead strip from processing lines in the works, to one of the accumulators in the storehouse, switching apparatus such as shown in FIG. 2 and 3, namely welder 70, and pinch rolls 76, 78, 80 which control the strip ends coming from the accumulators to be joined by welding or otherwise, are provided, preferably disposed at one or both ends of the storehouse. Strips are guided vertically up, to the floor level where the required accumulator is located, using guides such as shown in FIG. 5, and then horizontally on edge 206, 208, right or left, as the case may be, leading to such accumulator. The welder apparatus and the pinch rolls or equivalent, to control the strip ends one of which is to be welded to the subject strip, are in this case disposed to join strips in the "on edge" position.

Similar switches are provided to guide strips directed to go from the accumulators to tracks leading to processing lines or to be wound into coils and packing for shipment after the last processing operation.

Such central or regional intermediate storage warehouse could be operated by one or more operators, mostly by remote control but such operation requires frequent lightning-fast decisions with the inherent danger of errors. Consequently, a correctly planned computer control system is preferable. As example, in determining the sequence of orders to be run on a strip rolling mill whose output goes to (1) a plastic coating line, (2) an annealing and temper passing line and (3) two galvanizing lines, each one of which is fed from its one of more accumulators, the computer e.g. 226 operatively connected to the switches 218, 220, 222, 224, accumulators 194, 196, 198, 200, 202 and 204 and these lines, is programmed to consider the actual stock at each one of these accumulators, the sequence of switching the mill's production from one line to another, and the optimum sequence of strip sections that would be acceptable for the mill, for the best roll life, but also acceptable for a given processing line such as those in FIGS. 1 or 2 that feed such galvanizing lines.

Then, when a given batch of strip is actually going through the mill and from there to an accumulator that is feeding one line, the computer 226 is programmed to catch the moment when the last batch order that it has allotted to one line goes through the mill, to cause the end of that strip to be cut and the leading end of the following strip be joined by welding with the end of the strip leading to the accumulator of another one of the processing lines it has previously determined.

In order to make the operation of said computer means 226 more dependable and error-proof, apparatus may be provided which registers the operation of the several processing lines, in feet produced of each batch or order, as well as similar apparatus 302 which registers such input and output in said computer means both of which are directly connected to said computer means and stored in its memory system, to be instantly available when called for.

Control of such storehouse or even simpler systems involving travel of strip material in continuous lengths from one manufacturing operation to an accumulator and from there to the following one, is bound to involve a great number of such and similar decisions which are "natural" for a suitable computer, correctly programmed. But benefits in avoided errors, labor and material savings, keeping delays etc. are enormous and it is an added advantage of the subject invention that it lends itself to such control much easier and to a fuller degree than is possible with the present system of transporting finite length coils to and from the storehouse. But the main advantage is still in providing a labourless flow of strip material from one operation performed at a certain rate of speed to a variable capacity accumulator and on to the next operation which may be at a different time and different rate of speed, without damage, loss of time or material.

Although the invention has been described by reference to some embodiments, it is not intended that the novel apparatus and method be limited thereby but that modifications thereof are to be included as falling within the broad spirit and scope of the foregoing disclosures, the following claims and the appended drawings.

What is claimed is:

1. A plant for producing metal strips, comprising (a) a central intermediate storehouse for partly processed strips containing a plurality of variable capacity strip accumulators, (b) strip guiding tracks from said storehouse to and from strip processing lines situated at various locations in said plant, and (c) strip guiding tracks and reconnecting means within said storehouse to connect and/or disconnect strip arriving from, or destined to, said strip processing lines at said plant with selected accumulators at said storehouse.

2. Multistory storehouse for storing metal strips of a strip mill during time periods between consecutive manufacturing processes, said storehouse comprising a plurality of large capacity transient strip accumulators disposed one above the other, so that their structures are joined together to form a tower structure, the latter, in turn, being connected to like accumulator tower structures by the floor structures, to jointly constitute the frame of the storehouse structure to which are attached the walls and a roof.

3. Storehouse according to claim 2, containing in addition, means for receiving and guiding uncoiled metal strip conveyed to and from the various manufacturing posts situated outside said storehouse in said strip mill, means for severing and gripping individual strips, and for rejoining them with other strips, and apparatus for registering quantities and locations of strips admitted for storage and quantities and destinations of strips to be forwarded to said mill.

4. Intermediate storehouse system consisting of a storehouse according to claim 2, and a network of protected tracks provided for supporting, propelling and guiding strips of unlimited length to and from said storehouse.

5. An apparatus for manufacturing strip material by the passage thereof through a plurality of processing stages with the coiling thereof into self contained units only after its exit from the last stage, which strip is supplied by at least one large capacity strip accumulator with independently controllable entry and exit speeds, comprising (a) means for joining the tail end of the strip at the entry end of said accumulator to an additional supply of strip material prior to the exhaustion of the strip at the exit end of said accumulator, said additional supply of strip material being comprised of a plurality of large capacity transient strip accumulators, (b) a storehouse for housing said transient accumulators consisting of a framework of structural towers, each formed by a plurality of said accumulators axially superposed and joined together by the floor structures, (c) walls and roof supported by said framework for protectively enclosing said accumulators and their auxiliary equipment, and (d) conveying means extending from said storehouse to other units of the plant to transport strip material leading from or to said units as the need therefor arises.

6. An apparatus as set forth in claim 5, wherein the plurality of floor structures each provide room for a plurality of said transient accumulators, and a plurality of rollers supporting strip stored in said accumulators with stanchions supporting said rollers extending from the ground up to the top floor.

7. An apparatus aset forth in claim 6 wherein said last-mentioned accumulators are each formed of a pair of superposed coils of spiral convolutions in vertical planes wound in opposite directions, and in ready position for "on edge" transport.

8. An apparatus as set forth in claim 5, wherein said last-mentioned conveying means comprises a track for guiding strip in a slightly inclined "on edge" position, including spaced idler supporting rollers provided with V-grooves therein for receiving the bottom edge of said strip, and spaced cylindrical roller means on the side towards which said strip is leaning, for rotatingly engaging the flat plane of said strip.

9. An apparatus as set forth in claim 8, wherein the terminal portions of said conveying means adjacent to said storehouse are disposed in passages of said storehouse leading to the multiple levels thereof.

10. An apparatus as set forth in claim 8, including booster propelling means connected selectively to some of said last-mentioned roller means to counteract any accumulated friction which impedes the forward movement of a strip.

11. An apparatus as set forth in claim 8, wherein said last-mentioned roller means are arranged in opposed pairs to function as pinch rollers.

12. A plant for manufacturing metallic strip material, comprised of a plurality of processing facilities for subjecting the strip in a continuous length to successive treatments before coiling the strip into final coiled units upon exiting from the final processing facility, comprising (a) a large capacity transient strip accumulator whose entry and exit velocities are independently controllable, immediately in advance of said final facility, adapted to feed strip existing from said accumulator continuously into said last-mentioned facility preparatory to the coiling thereof at the outlet of the latter, and (b) a plurality of auxiliary large capacity transient strip accumulators whose entry and exit velocities are independently controllable containing strip which had been treated in said processing facilities other than said final facility, (c) a protective warehouse for storing said auxiliary accumulators, and (d) track means, extending between said auxiliary accumulators in said warehouse and said processing facilities, for guiding the strip therebetween in a nearly vertical upright attitude.

13. A plant as set forth in claim 12, wherein said track means comprises spaced grooved rollers supporting the bottom edge of said strip and spaced cylindrical rollers supporting the slightly inclined face of said strip.

14. A plant as set forth in claim 12, including means for connecting the trailing end of the strip at the entry end of said first-mentioned accumulator to the strip stored temporarily in any one of said auxiliary accumulators in said warehouse for transport to said first-mentioned accumulator and final processing facility.

15. A plant as set forth in claim 12, including means for changing the horizontal attitude of the strip at a processing facility to a nearly vertical upright attitude for travel on said track means, comprising (a) a rigid base-plate support with an inclined mast attached thereto; and (b) a plurality of branches emanating radially from said mast with a small roller affixed to the free end of each branch for contact with the plane of said strip.

16. Apparatus for manufacture of metallic strips out of pre-rolled strips consisting of (a) butt welding line for joining coils of said pre-rolled strips into one continuous band, (b) an accumulator storehouse containing a plurality of accumulators, (c) processing facilities, each capable of performing one manufacturing step, such as descaling, cold rolling, annealing, coating, temper rolling, etc., (d) strip supporting and guiding tracks leading from said facilities to said accumulator storehouse consisting of grooved rollers to support the bottom edge of the strip and cylindrical rollers to support the slightly inclined face of the strip, both disposed at spaced intervals, (e) similar tracks for leading the strip from accumulators contained in said storehouse to the respective processing facilities, and (f) coil winding and cutting equipment disposed downstream of the last one of said processing facilities.

* * * * *